United States Patent [19]

Elgart

[11] 4,265,476

[45] May 5, 1981

[54] WORK-HOLDING DEVICE

[76] Inventor: Alan Elgart, R.D. 4, P.O. Box 70B, Beakes Rd., New Windsor, N.Y. 12550

[21] Appl. No.: 66,011

[22] Filed: Aug. 13, 1979

[51] Int. Cl.[3] ..... B25B 11/00; B66C 1/02; F21V 33/00

[52] U.S. Cl. ..... 294/64 R; 296/21; 362/32

[58] Field of Search ..... 294/1 CA, 64 R; 51/216 LP, 229, 235; 269/21; 279/3; 350/96.26; 356/30, 239, 244; 362/32, 119, 120

[56] References Cited

U.S. PATENT DOCUMENTS

| | | | |
|---|---|---|---|
| 1,987,336 | 1/1935 | Powell | 294/64 R X |
| 2,922,873 | 1/1960 | Bibbero et al. | 294/64 R X |
| 3,424,486 | 1/1969 | Corley | 294/64 R |
| 3,582,638 | 6/1971 | Peters | 362/32 |
| 3,791,689 | 2/1974 | Boone et al. | 294/1 CA |

*Primary Examiner*—Johnny D. Cherry

*Attorney, Agent, or Firm*—Stephen E. Feldman; Marvin Feldman

[57] ABSTRACT

A work-holding device comprises a body member having an aperture on a first end. A vacuum producing device is operably connected with the body member for creating a vacuum at the aperture. An illumination device is disclosed within the body member for illuminating the aperture.

10 Claims, 2 Drawing Figures

WORK-HOLDING DEVICE

BACKGROUND OF THE INVENTION

While the invention is subject to a wide range of applications, it is especially suited for use as a work-holder and will be particularly described in that connection.

In the past, there have been a number of different types of work-holders which have been used for moving, holding, and picking up different components and particularly hard-to-handle items, such as gems. In addition, some of these work-holders include a light source to facilitate examining the object which is being held.

For example, U.S. Pat. No. 2,376,448 to Neugass discloses a tweezer implement which has a light source provided in the housing.

U.S. Pat. No. 3,515,484 to Normand discloses a vacuum chuck for holding optical lenses and includes the concept of a light source associated with a microscope for illuminating the lens which may be held within the chuck.

Still there has remained the problem of having a portable, hand-held, work-holding device which uses a vacuum for picking up an otherwise hard-to-handle item including a light source whereby the item can be easily examined.

It is an object of the present invention to provide a work-holding device which substantially obviates one or more of the limitations and disadvantages of the described prior arrangements.

It is a further object of the present invention to provide an improved work-holding device which is easy to operate and handle.

It is still a further object of the present invention to provide a work-holding device which is relatively inexpensive to manufacture.

It is a yet further object of the present invention to provide a work-holding device which provides both a system for holding the object as well as a light source for viewing the object.

SUMMARY OF THE INVENTION

Accordingly, there has been provided a work-holding device comprising a body member having an aperture on a first end. A vacuum producing device is operably connected with the body member for creating a vacuum at the aperture. An illumination device is disclosed within the body member for illuminating the aperture.

For a better understanding of the present invention, together with other and further objects thereof, reference is had to the following description, taken in connection with the accompanying drawings.

DESCRIPTION OF THE PREFERRED EMBODIMENT

Figure 1:
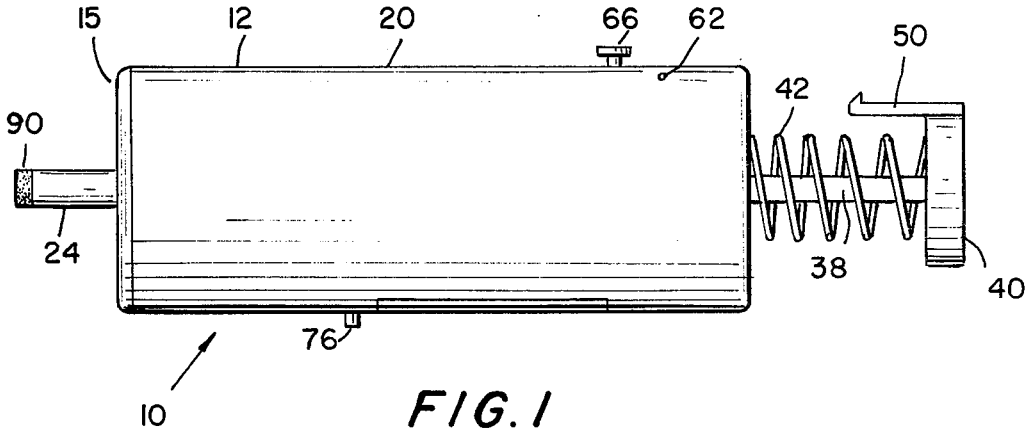
FIG. 1 is a side view of a work-holding device in accordance with the present invention.

A work-holding device 10 comprises a body member 12 having an aperture 14 on a first end 15. A vacuum device 16 is operably connected with the body member for creating a vacuum at the aperture. An illumination device 18 is disposed within the body member 12 for illuminating the aperture 14.

Figure 2:
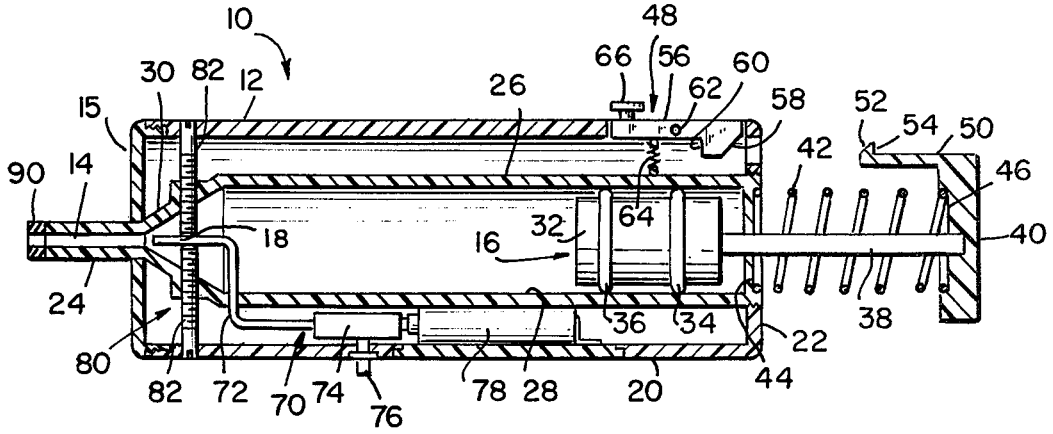
FIG. 2 is a side view, partly in cross-section of the work-holding device.

A body member 12 as illustrated in FIG. 2 includes a hollow cylindrical portion 20 having a first end 15 and a second end 22. The body member has a tip element 24 which extends from the first end and provides an aperture 14. Although the hollow cylindrical portion 20 as seen in FIG. 1 is preferably of a cylindrical shape so that the work-holding device 10 can be easily hand-held and hand-carried, it is within the scope of the present invention to form it in any desired shape, such as triangular, or octagonal cross-section. The body member may be formed of any desirable material, such as for example, plastic.

A vacuum producing device 16 includes a cylinder 26 in the body member having a hollow bore 28 therein. The end of the bore 28 is connected to the tip 24 by a conical end 30. A piston 32 is received within the hollow bore 28 and may include two seal elements 34 and 36. Although these seal elements are illustrated as being formed as part of the piston 32, it is within the scope of the present invention to use any conventional seal structure as desired, such as for example, removable seal rings. A rod 38 is affixed to the piston and extends out of the second end 22 of the body member 12. On the other end of the rod, there is affixed an end element 40 which is preferably circular in shape. A stop ridge (not shown) may be provided at the back end of bore 28 to prevent the piston 32 from sliding out of the bore.

Piston operating means comprises a coil spring device 42 placed between the end element 40 and the second end 22 of the body member for biasing the piston away from the aperture 14. The second end 22 of the body member may include a circular groove 44 against which the spring 42 may be secured. Also, the end element 40 may have a circular groove 46 for retaining the other end of the spring device. It is within the scope of the present invention, to use any desired type of spring device, as well as any conventional manner of attaching the spring device to the body member and the end element 40. In general, the spring device 42 acts to move the end element 40 away from the second end 22 and thereby cause the piston 32 to move within the hollow bore 28 and create a vacuum between the piston and the aperture 14.

Further piston operating means includes a latch structure 48 for locking the piston 32 in its closest position to the aperture 14. The latch structure 48 includes a fixed latch element 50 which is affixed to the edge of the end element 40. The fixed latch element 50 includes an inclined surface 52 and a latch edge 54. The latch structure 48 also includes a pivoting latch element 56 which has an inclined surface 58 and a latch edge 60. The latch element 56 may pivot about a pivot pin 62 and a compression spring 64 acts to keep the inclined surface portion of the latch element biases towards the cylinder 26. A latch release button 66 is affixed to the latch element on the other side of the pivot pin 62 from the inclined surface 58. In operation, when the inclined surface 52 of the fixed latch element 50 pushes against the inclined surface 58 of the pivoting latch element 56, the latch element 56 moves counterclockwise around the pivot pin 62 until the latch edge 54 passes the latch edge 60. Then the spring 64 returns the pivoting latch element 56 to its normal position and thereby locks the fixed latch element 50 in place. When the release button 66 is depressed, the latch edge 60 moves out of contact with the latch element 50 and the spring 42 moves the end element 40 with its attached latch element 50 away from the second end of the body member 12.

An illumination device 18 is disposed within the body member 12 for illuminating the aperture 14. A fiber optic light device 70 extends within the body member and includes a glass fiber optic light guide 72 which is connected to a conventional light source 74. The light source 74 may include a tungsten light which is focused by a lens (neither of which is illustrated) onto the end of the light guide affixed to the light source. A switch 76 is provided to turn on the light source as desired. A power source 78, which may comprise a standard battery, is connected within the body member in any desired manner as shown. A positioning device 80 is provided to support the fiber optic light guide 72 to shine the light through the aperture 14. The positioning device may include several set screws 82 which are supported in the conical end 30 to hold the light guide in place. It is within the scope of the present invention, to use any desired type of positioning device to fulfill this purpose.

An important aspect of the present invention is to provide a flexible seal 90 on the end of the hollow tip element 24 so as to surround the aperture 14. The seal 90 tightly seals the object to be picked up against the tip 14 of the work-holding device 10. The seal may be made of any desirable material, such as for example rubber, which can conform to the irregular shape of an object to be lifted. The seal may be attached to the end of the tip 24 by any desired manner such as for example, epoxy glue.

To more fully understand the present invention, an explanation of its operation follows: The work-holding device 10 may be held in the operators hand and the end element 40 is pushed towards the second end 22 of the body member 12 until the latch structure 48 is engaged, as explained above. Then, the flexible seal can be pressed against an object such as, for example, a diamond so as to make a tight seal between the object and the flexible seal material. By pushing the release button 66, the latch is released and the spring 42 causes the piston 32 to move away from the aperture 14. This creates a vacuum between the hollow bore 28 and the aperture 14 so that the object is held against the end of the tip 24. Then, the switch 76 can be turned to an "on" position, whereby light is directed through the aperture and the object held on the end of the tip. The object can then be conveniently moved about and viewed.

When it is desired to release the object, the end element 40 is simply pushed towards the second end 22. The vacuum slowly decreases and allows the object to drop away from the seal 90. An important aspect of the present invention, is that the slow loss of vacuum allows the item, such as the diamond, to simply drop without being propelled some distance and risk the chance of losing the diamond.

Thus, it can be seen by one skilled in the art that there has been provided a work-holding device which is easy to operate, relatively inexpensive to manufacture and can both carry and illuminate an object supported on its end.

While there has been described what is at present considered to be the preferred embodiment of the present invention, it will be obvious to those skilled in the art that various changes and modifications may be made therein, without departing from the invention, and is is, therefore, aimed in the appended claims to cover all such changes and modifications as fall within the true spirit and scope of the invention.

What is claimed is:

1. A work holding device, comprising:

an outer rigid member having disposed within;

an inner rigid member concentric with said outer member having;

an aperture on a first end of said inner member; and vacuum producing means, including a cylinder as said inner member connected to said aperture and a piston reciprocably received within said inner member for creating a vacuum at said aperture when said piston moves away from said aperture; and illumination means disposed within said outer member for illuminating said aperture.

2. The work-holding device as defined in claim 1 further characterized in that piston operating means is connected to said piston and extends out of a second end of said inner member for moving said piston towards and away from said aperture.

3. The work-holding device as defined in claim 2 further characterized in that said piston operating means includes a latch means for locking said piston in its closest position to said aperture and a spring means for biasing said piston away from said aperture to create a vacuum.

4. A work holding device, comprising:

an outer rigid member having disposed entirely within;

an inner rigid member concentric with said outer member having;

an aperture on a first end of said inner member, and vacuum producing means, including a cylinder as said inner member connected to said aperture and a piston reciprocably received within said inner member for creating a vacuum at said aperture when said piston moves away from said aperture; and illumination means disposed within said outer member for illuminating said aperture.

5. The work-holding device as defined in claim 4 further characterized in that said illumination means includes fiber optic light means extending within said outer member for illuminating said aperture.

6. The work-holding device as defined in claim 5 further characterized in that a power source means is disposed within said outer member to illuminate said fiber optic means.

7. The work-holding device as defined in claim 6 further characterized in that said illumination means includes positioning means for supporting said fiber optic light means within said inner member so that light shines through said aperture.

8. The work-holding device as defined in claim 4 further characterized in that said outer member includes a substantially hollow cylindrical portion for hand-holding and hand-carrying the work holding device.

9. The work-holding device as defined in claim 8 further characterized in that said inner member further includes a hollow tip element extending from said first end to provide said aperture.

10. The work-holding device as defined in claim 9 further characterized in that flexible seal means are provided on said hollow tip element around said aperture.

* * * * *